US011469092B2

(12) United States Patent
Kenttamaa et al.

(10) Patent No.: US 11,469,092 B2
(45) Date of Patent: Oct. 11, 2022

(54) MULTI-CHANNEL PULSED VALVE INLET SYSTEM AND METHOD

(71) Applicant: Purdue Research Foundation, West Lafayette, IN (US)

(72) Inventors: Hilkka Kenttamaa, West Lafayette, IN (US); Ryan Hilger, Lafayette, IN (US); Ravikiran Yerabolu, Harrison, NJ (US); John Kong, West Lafayette, IN (US); Tiffany Prentice, North Plainfield, NJ (US); Chunfen Jin, Des Plaines, IL (US)

(73) Assignee: Purdue Research Foundation, West Lafayette, IN (US)

( * ) Notice: Subject to any disclaimer, the term of this patent is extended or adjusted under 35 U.S.C. 154(b) by 39 days.

(21) Appl. No.: 16/855,625

(22) Filed: Apr. 22, 2020

(65) Prior Publication Data

US 2020/0365384 A1 Nov. 19, 2020

Related U.S. Application Data

(60) Provisional application No. 62/836,860, filed on Apr. 22, 2019.

(51) Int. Cl.

| | |
|---|---|
| ***H01J 49/42*** | (2006.01) |
| ***H01J 49/00*** | (2006.01) |
| ***H01J 49/04*** | (2006.01) |

(52) U.S. Cl.

CPC ..... *H01J 49/4225* (2013.01); *H01J 49/0036* (2013.01); *H01J 49/0495* (2013.01)

(58) Field of Classification Search

CPC . H01J 49/4225; H01J 49/0036; H01J 49/0495
See application file for complete search history.

(56) References Cited

U.S. PATENT DOCUMENTS 6,066,848 A * 5/2000 Kassel ..... H01J 49/165 250/285
6,207,954 B1 * 3/2001 Andrien, Jr ..... H01J 49/0009 250/282

(Continued)

OTHER PUBLICATIONS

Multiported Pulsed Valve Interface for a Linear Quadrupole Ion Trap Mass Spectrometer to Enable Rapid Screening of Multiple Functional-Group Selective Ion-Molecule Reactions Tiffany Jarrell, James Riedeman, Mark Carlsen, Randall Replogle, Tim Selby, and Hilkka Kenttamaa' Perdue unv (Year: 2014).*

(Continued)

*Primary Examiner* — Sean M Luck
(74) *Attorney, Agent, or Firm* — Maginot, Moore & Beck LLP

(57) ABSTRACT

A multichannel inlet system for a mass spectrometer includes a plurality of valve assemblies coupled to a manifold, and a pulsed valve driver. The manifold is configured to be connected in fluid connection with an ion trap of the mass spectrometer. Each valve assembly includes a valve and an injection port operably coupled to receive the reagent. The valve has an actuated state in which the valve provides fluid communication between the injection port and the manifold, and an unactuated state in which the valve substantially prevents fluid communication between the injection port and the manifold. The pulsed valve driver is operably connected to receive a pulse signal sequence from a processor, and is configured to generate pulsed valve drive signals for one or more of the valves based on the pulse signal sequence to cause a corresponding one of the valves to be in the actuated state.

16 Claims, 9 Drawing Sheets

(56) References Cited

U.S. PATENT DOCUMENTS

| | | | | |
|---|---|---|---|---|
| 6,501,073 | B1 * | 12/2002 | Mylchreest | H01J 49/04 250/288 |
| 6,690,006 | B2 * | 2/2004 | Valaskovic | G01N 30/7266 250/288 |
| 6,841,774 | B1 * | 1/2005 | Weiss | H01J 49/0495 250/288 |
| 7,439,499 | B2 * | 10/2008 | Bailey | H01J 49/0431 250/285 |
| 8,080,783 | B2 * | 12/2011 | Whitehouse | H01J 49/26 250/288 |
| 9,257,269 | B2 * | 2/2016 | Wu | C07B 63/00 |
| 2007/0023679 | A1 * | 2/2007 | Reilly | H01J 49/0031 250/426 |
| 2009/0194684 | A1 * | 8/2009 | Guna | H01J 49/0063 250/282 |
| 2009/0194686 | A1 * | 8/2009 | Guna | H01J 49/063 250/283 |
| 2011/0174965 | A1 * | 7/2011 | Collings | H01J 49/0481 250/283 |
| 2018/0323051 | A1 * | 11/2018 | Polfer | H01J 49/422 |

OTHER PUBLICATIONS

McLuckey, S. A. Principles of Collisional Activation in Analytical Mass Spectrometry. J. Am. Soc. Mass Spectrom. 1992, pp. 599-614, 3 (6).

Schwartz, J. C.; Senko, M. W.; Syka, J. E. P. A Two-Dimensional Quadrupole Ion Trap Mass Spectrometer. J. Am. Soc. Mass Spectrom 2002, pp. 659-669, 13 (6).

Campbell, K. M.; Watkins, M. A.; Li, S.; Fiddler, M. N.; Winger, B.; Kenttämaa, H. I. Functional Group Selective Ion/Molecule Reactions: Mass Spectrometric Identification of the Amido Functionality in Protonated Monofunctional Compounds. J. Org. Chem. 2007, pp. 3159-3165, 72 (9).

Eismin, R. J.; Fu, M.; Yem, S.; Widjaja, F.; Kenttämaa, H. I. Identification of Epoxide Functionalities in Protonated Monofunctional Analytes by Using Ion/Molecule Reactions and Collision-Activated Dissociation in Different Ion Trap Tandem Mass Spectrometers. J. Am. Soc. Mass Spectrom. 2012, pp. 12-22, 23 (1).

Sheng, H.; Williams, P. E.; Tang, W.; Zhang, M.; Kenttämaa, H. I. Identification of the Sulfoxide Functionality in Protonated Analytes via Ion/Molecule Reactions in Linear Quadrupole Ion Trap Mass Spectrometry. Analyst 2014, pp. 1296-4302, 139 (17).

Gronert, S. Estimation of Effective Ion Temperatures in a Quadrupole Ion Trap. J. Am. Soc. Mass Spectrom. 1998, pp. 845-848, 9 (8).

Poad, B. L. J.; Pham, H. T.; Thomas, M. C.; Nealon, J. R.; Campbell, J. L.; Mitchell, T. W.; Blanksby, S. J. Ozone-Induced Dissociation on a Modified Tandem Linear Ion-Trap: Observations of Different Reactivity for Isomeric Lipids. J. Am. Soc. Mass Spectrom. 2010, pp. 1989-1999, 21 (12).

Harman, D. G.; Blanksby, S. J. Investigation of the Gas Phase Reactivity of the 1-Adamantyl Radical Using a Distonic Radical Anion Approach. Org. Biomol. Chem. 2007, pp. 3495-3503, 5 (21).

Habicht, S. C.; Vinueza, N. R.; Amundson, L. M.; Kenttämaa, H. I. Comparison of Functional Group Selective Ion-Molecule Reactions of Trimethyl Borate in Different Ion Trap Mass Spectrometers. J. Am. Soc. Mass Spectrom. 2011, pp. 520-530, 22 (3).

Emary, W. B.; Kaiser, R. E.; Kenttämaa, H. I.; Cooks, R. G. Pulsed Gas Introduction into Quadrupole Ion Traps. J. Am. Soc. Mass Spectrom. 1990, pp. 308-311, 1 (4).

Einhorn, J.; Kenttämaa, H. I.; Cooks, R. G. Information on the Location of Carbon-Carbon Double Bonds in C6—C23 Linear Alkenes from Carbon Addition Reactions in a Quadrupole Ion Trap Equipped with a Pulsed Sample-Inlet System. J. Am. Soc. Mass Spectrom. 1991, pp. 305-313, 2 (4).

Coopersmith, B. I.; Yost, R. A. Internal Pulsed Valve Sample Introduction on a Quadrupole Ion Trap Mass Spectrometer. J. Am. Soc. Mass Spectrom. 1995, pp. 976-980, 6 (10).

* cited by examiner

MULTI-CHANNEL PULSED VALVE INLET SYSTEM AND METHOD

This application claims the benefit of U.S. Provisional Patent Application Ser. No. 62/836,860, filed Apr. 22, 2019, which is incorporated in its entirety by reference herein.

GOVERNMENT LICENSE RIGHTS

This invention was made with government support under Contract DE-SC0000997 awarded by the Department of Energy. The government has certain rights in the invention.

FIELD OF THE INVENTION

The invention relates generally to mass spectrometry, and more specifically, to the introduction of reagents for ion/molecule reactions in mass spectrometry.

BACKGROUND

Mass spectrometry is a known analytical technique that measures the mass-to-charge ratio of ions. Mass spectrometry is used to quantify known materials, to identify unknown compounds within a sample, and to elucidate the structure and chemical properties of different molecules. The measured mass-to-charge ratio, for example, can be compared to that of known compounds. The complete process involves the conversion of the sample into gaseous ions, with or without fragmentation, which are then characterized by their mass to charge ratios (m/z) and relative abundances.

One type of mass spectrometry is tandem mass spectrometry ($MS^n$), a technique where two or more mass analysis steps are utilized to explore an additional reaction to increase their abilities to analyze chemical samples. Tandem mass spectrometry can employ a technique known as collision-activated dissociation (CAD) for the structural elucidation of ionized compounds. CAD is a mass spectrometry technique that induces fragmentation of selected ions in the gas phase. The selected ions (typically molecular ions or protonated molecules) are usually accelerated by applying an electrical potential to increase the ion kinetic energy and then allowed to collide with neutral atoms or molecules. In each collision, some of the kinetic energy is converted into internal energy which results in bond breakage and the fragmentation of the ion into smaller fragments. These fragment ions can then be analyzed using the second mass analysis step in tandem mass spectrometry experiments.

However, in cases where the fragmentation patterns for ionized isomeric compounds are very similar, identification becomes impossible. Accordingly, gas-phase ion/molecule reactions have been used extensively in the past for solving complex analytical problems. These reactions have been used to probe the structures of organic compounds and biomolecules. One major area of focus for ion/molecule reactions is in the identification of functional groups in organic compounds. Compounds containing amido, carboxylic acid, epoxide, N-oxide, sulfone, and sulfoxide functionalities, can be identified using this technique. More importantly, isomeric compounds, such as primary, secondary and tertiary amines, can be differentiated with gas-phase ion/molecule reactions, as discussed in Fu, M.; Eismin, R. J.; Duan, P.; Li, S.; Kenttämaa, H. I., "Ion-molecule Reactions Facilitate the Identification and Differentiation of Primary, Secondary and Tertiary Amino Functionalities in Protonated Monofunctional Analytes in Mass Spectrometry." *Int. J. Mass Spectrom.* 2009, 282 (3), 77-84.

The neutral reagents required to induce these ion/molecule reactions can be introduced into a mass spectrometer via a continuous flow. The continuous flow introduction of neutral reagents has been widely used and has been adapted to many types of mass spectrometers. These instruments include triple quadrupoles, pentaquadrupoles, Fourier-transform ion cyclotron resonance (FT-ICR) mass spectrometers, three-dimensional quadrupole ion traps (3-D QITs), linear quadrupole ion traps (LQITs), ion mobility mass spectrometers, and hybrid mass spectrometers. Because the reagent is introduced continuously and maintained at a constant pressure inside of the mass spectrometer, reaction rates can be directly measured and can offer insights on reaction mechanisms.

However, the continuous flow approach can lead to unwanted ion/molecule reactions during further $MS^n$ experiments involving CAD of the ion/molecule reaction products. The unwanted ion/molecule reactions can produce additional ions that can complicate the CAD mass spectrum. Moreover, the continuous flow approach is limited to the use of one reagent at any given time, which prevents high-throughput screening. To avoid above issues, reagents can be pulsed into a mass spectrometer for ion/molecule reactions. The pulsed introduction of reagents has been successfully demonstrated in the past with the incorporation of a pulsed valve to a FT-ICR mass spectrometer, as discussed in Carlin, T. J.; Freiser, B. S., "Multiphoton Ionization in Fourier Transform Mass Spectrometry." *Anal. Chem.* 1983, 55 (6), 955-958, and Sack, T. M.; Gross, M. L., "Pulsed Valve Interface for Gas Chromatography/Fourier Transform Mass Spectrometry." *Anal. Chem.* 1983, 55 (14), 2419-2421. Pulsed introduction has also been demonstrated in a 3-D quadrupole ion trap, as discussed, for example, in Emary, W. B.; Kaiser, R. E.; Kenttämaa, H. I.; Cooks, R. G., "Pulsed Gas Introduction into Quadrupole Ion Traps." *J. Am. Soc. Mass Spectrom.* 1990, 1 (4), 308-311.

A downside to this method is that reaction kinetics cannot be readily measured. All of the above pulsed methods only incorporated a single pulsed valve for reagent introduction. To overcome this limitation, a pulsed valve inlet system has been developed that incorporates three pulsed valves for the introduction of three reagents. This system is discussed in Jarrell, T.; Riedeman, J.; Carlsen, M.; Replogle, R.; Selby, T.; Kenttämaa, H. Multiported Pulsed Valve Interface for a Linear Quadrupole Ion Trap Mass Spectrometer to Enable Rapid Screening of Multiple Functional-Group Selective Ion-Molecule Reactions. *Anal. Chem.* 2014, 86 (13), 6533-6539.

That system allowed for the consecutive introduction of three different reagents into a mass spectrometer for rapid gas-phase ion/molecule reactions during a high performance liquid chromatography (HPLC) separation. While that system experimentally demonstrated the ability to introduce multiple reagents into a mass spectrometer, the techniques and equipment for introducing multiple reagents require refinement to enable practical use on a larger scale.

SUMMARY

At least some embodiments described herein address the above described need, as well as others, by providing multiple pulsed valve reagent introduction with improved functionality and ease of use.

A first embodiment is a multichannel inlet system for a mass spectrometer that includes a plurality of valve assemblies coupled to a manifold, and a pulsed valve driver. The manifold is configured to be connected in fluid connection with an ion trap of the mass spectrometer. Each valve assembly includes a valve and an injection port operably coupled to receive the reagent. The valve has an actuated state in which the valve provides fluid communication between the injection port and the manifold, and an unactuated state in which the valve substantially prevents fluid communication between the injection port and the manifold. The pulsed valve driver is operably connected to receive a pulse signal sequence from a processor, and is configured to generate pulsed valve drive signals for one or more of the valves based on the pulse signal sequence to cause a corresponding one of the valves to be in the actuated state.

The above-described features and advantages, as well as others, will become more readily apparent to those of ordinary skill in the art by reference to the following detailed description and accompanying drawings.

DETAILED DESCRIPTION

Figure 1:
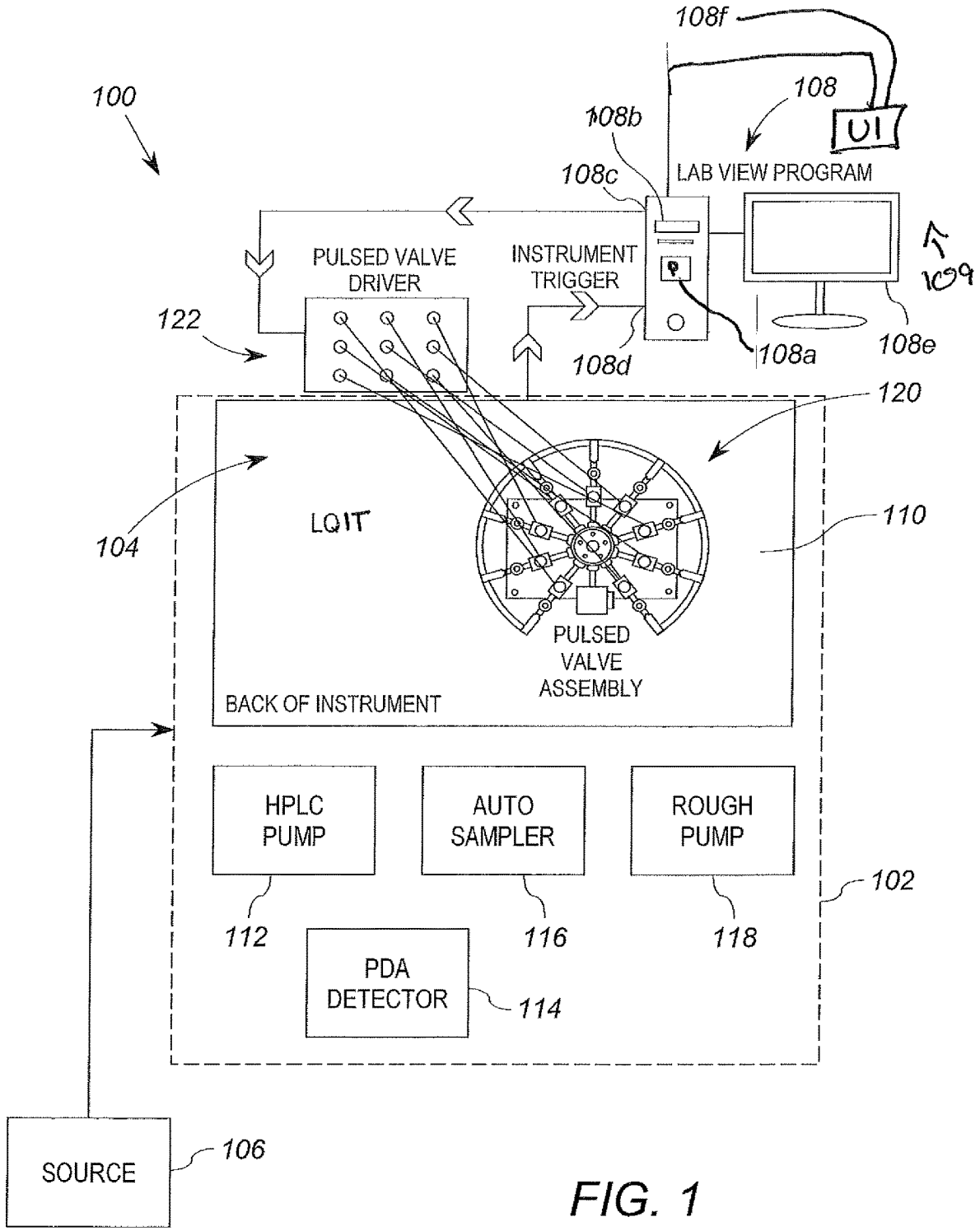
FIG. 1 shows a schematic block diagram of a pulsed valve mass spectrometry system according to a first embodiment.

FIG. 1 shows a schematic block diagram of an ion/molecule reaction mass spectrometry system 100 that includes a mass spectrometer 102, a multichannel inlet system 104, a sample source 106, and computing device 108. The mass spectrometer 102 includes an ion trap 110 and a rough pump 118, among other known elements. The mass spectrometer 102 in this embodiment is a linear quadrupole ion trap (LQIT) mass spectrometer, but may suitably be another type of mass spectrometer that includes an ion trap and a rough pump. The mass spectrometer 102 is configured with a high pressure or performance liquid chromatography (HPLC) pump 112, an HPLC PDA detector 114, and an HPLC autosampler 116. The elements of suitable LQIT mass spectrometer systems are known in the art and will not be described herein in detail.

The sample source 106 may suitably be an atmospheric pressure chemical ionization (APCI) source that ionizes compounds in a sample for use in the ion/molecule reactions in the ion trap 110. The sample source 106 may alternatively be an electrospray ionization (ESI) source that is configured to produce ions using an electrospray in which a high voltage is applied to the liquid sample to create an aerosol. The system may include both APCI and ESI sources, among others.

The computing device 108 may be or include a computer workstation, portable computing device, personal computer, or other device that includes at least one microprocessor or other processor (processor 108*a*) programmed to perform the operations described herein, along with suitable circuitry to allow operation of the microprocessor. To this end, the processor 108*a* performs computing instructions stored in memory 108*b*, for example, a non-transitory data storage medium, to perform at least the operations attributed to it herein.

In this embodiment, the computing device 108 includes interfaces 108*c*, 108*d* that allow for, respectively, the output of logic signals generated by the processor 108*a*, and analog or digital input signals that include information used by the processor 108*a*. The computing device 108 also includes a display 108*e* and input devices 108*f* that collectively form a graphical user interface 109 that allows a user to interact with the processor 108*a*.

The multichannel inlet system 104 includes a multichannel valve assembly 120 and a pulsed valve driver 122. The multichannel valve assembly 120 is an assembly that is operably coupled and configured to pulse a plurality of different reagents at different times into the ion trap 110 in accordance with pulsed valve drive signals received from the pulsed valve driver 122. The pulsed valve driver 122 is operably connected to receive a pulse signal sequence from the computing device 108, and is configured to generate pulsed valve drive signals for one or more valves based on the pulse signal sequence, as will be discussed below in further detail.

Figure 2:
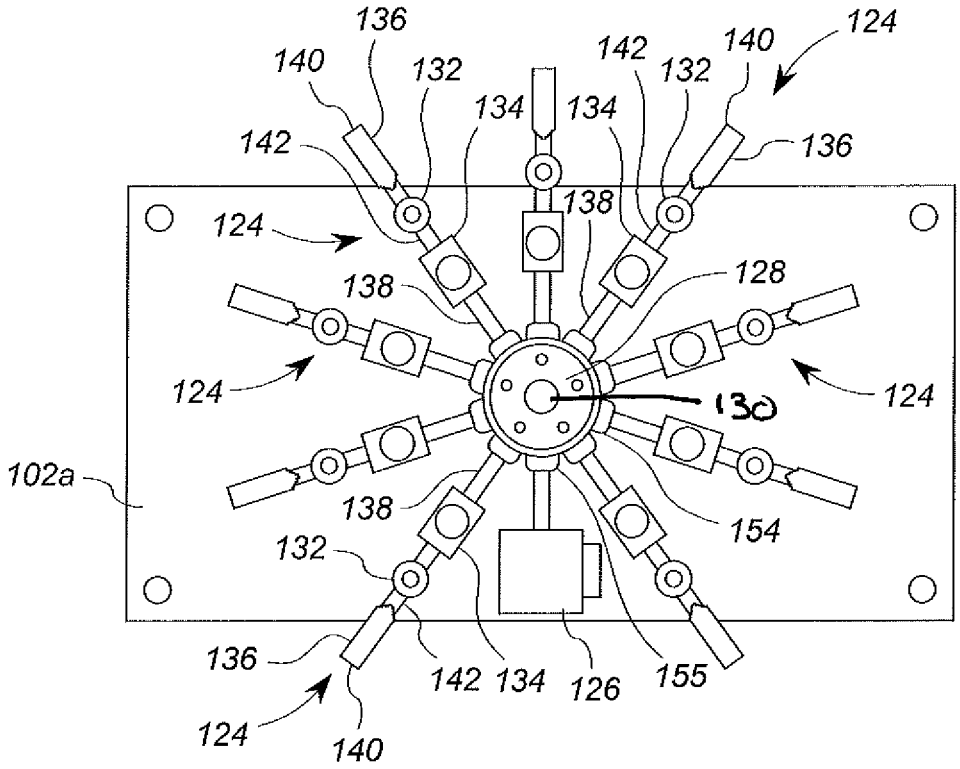
FIG. 2 shows a functional diagram of the multichannel valve assembly of the system of FIG. 1.

FIG. 2 shows a functional diagram of the multichannel valve assembly 120 in further detail. With contemporaneous reference to FIGS. 1 and 2, the multichannel valve assembly 120 includes a plurality of valve assemblies 124, a variable leak valve 126, a central manifold 128, and a plunger 130. Each valve assembly 124 includes an injection port 132, a first valve 134, a second valve 136, a first end 138, and a second end 140, and a reagent chamber 142. In general, the first valve 134 is disposed between the reagent chamber 142 and the first end 138, and the second valve 136 is disposed between the reagent chamber 142 and the second end 140. When the first valve 134 is open, the first end 138 is in fluid communication with the reagent chamber 142, and when the second valve 136 is open, the second end 140 is in fluid communication with the reagent chamber 142.

Each injection port 132 is in fluid communication with the reagent chamber 142, and is configured to receive a syringe therethrough for injecting liquid or dissolved reagent into the reagent chamber 142. Each first valve 134 is an electrically actuated valve having an actuated state in which the valve 134 provides fluid communication between the reagent chamber 142 and the first end 138, and an unactuated state in which the valve 134 substantially prevents fluid communication between the reagent chamber 142 and the first end 138. Each second valve 136 is a two-way valve having an open state in which the valve 136 provides fluid communication between the reagent chamber 142 and the second end 140, and a closed state in which the valve 136 substantially prevents fluid communication between the reagent chamber 142 and the second end 140.

Figure 3:
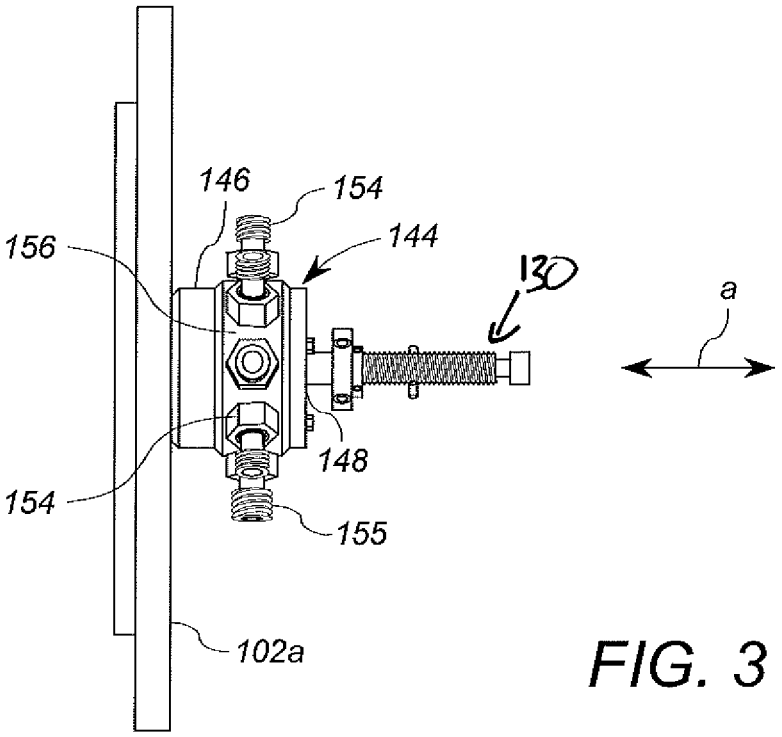
FIG. 3 shows a side view of the common manifold of the multichannel valve assembly of FIG. 2.

FIG. 3 shows a side view of the manifold 128 apart from the rest of the multichannel valve assembly 120. With reference to FIGS. 2 and 3, the manifold 128 is a form of multi-inlet coupling device that includes a connection wheel 144, a back plate coupler 146, and a plunger receiver 148. The back plate coupler 146 is configured to couple to a back plate 102*a* of an enclosure for an ion trap of a mass spectrometer, such as the mass spectrometer 102 of FIG. 1. The back plate 102*a* is also illustrated in FIGS. 2 and 3 for context.

The back plate coupler 146 extends axially from the back plate 102*a* along an axis a. The connection wheel 144 is coupled to the back plate coupler 146, and includes a plurality of spoke ports 154, 155 disposed about an annular surface 156. The connection wheel 144 and the back plate coupler 146 are configured to provide fluid communication between each of the spoke ports 154 and the ion trap 110 when the back plate coupler 146 is coupled to the ion trap 110 via back plate 102*a*.

As shown in FIGS. 1 and 2, each of the spoke ports 154 is coupled to the first end 138 of a corresponding valve assembly 124. The coupling may suitably be a known couple that provides an easy way to remove the valve assembly 124 for cleaning and maintenance. The other spoke port 155 is operably coupled to the variable leak valve 126. The variable leak valve 126 is further coupled to a source of helium or other inert gas such as nitrogen or argon. As disclosed herein the spoke ports 154, 155 extend radially outward (with respect to the axis a) from the annular surface 156 of the connection wheel 144. In this embodiment, ten spoke parts are evenly spaced apart on the annular surface 156 about the axis a. The valve assemblies 124 extend generally radially (from first end 138 to second end 140), in alignment with their respective spoke ports 154. The configuration of the spoke ports 154 on the connection wheel 144 and the valve assemblies 124 allow for a relatively short travel of reagent from the reagent chamber 142 to the ion trap 110, while advantageously also allowing for ease of access to the injection ports 132 and second valves 136.

It will be appreciated that the connection wheel 144 may have more or less spoke ports 154, as needed or desired. Likewise, the connection wheel 144 need not have a cylindrical outer surface (annular wall 156). The connection wheel 144 may instead have a polygonal outer surface instead of annular wall 156, which still allow a plurality spoke ports to extend generally away in different directions, for ease of use and reduced reagent travel.

As discussed above, the pulsed valve driver 122 of FIG. 1 is operably connected to receive a pulse signal sequence from the computing device 108, and is configured to generate pulsed valve drive signals for one or more of the valves 134 based on the pulse signal sequence. The pulsed valve driver 122 is further operably connected to provide pulsed valve drive signals to at least some of the plurality of valves 134. Each pulsed valve drive signal is configured to cause a corresponding one of the valves 134 to be in the actuated state.

Figure 4:
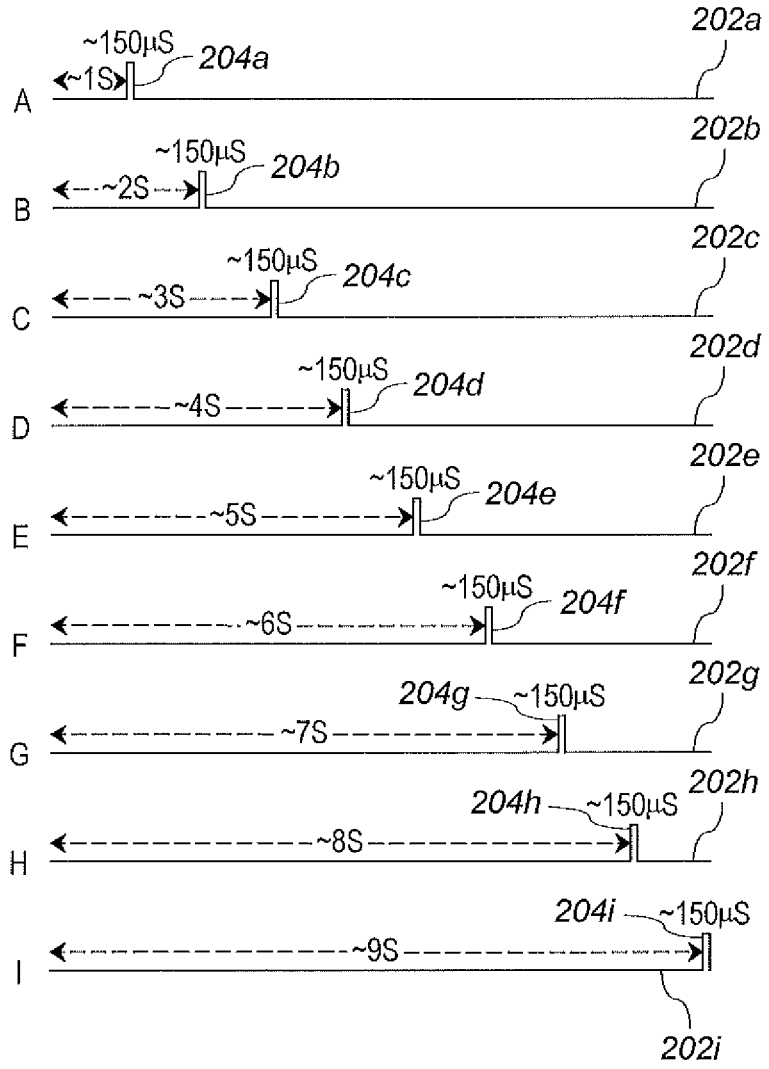
FIG. 4 shows a timing diagram of an exemplary pulse signal sequence generated by the computing device of the system of FIG. 1.

FIG. 4 shows a timing diagram of an exemplary pulse signal sequence 200 as received from the computing device. The pulse signal sequence comprises, in this case, nine signals 202*a*-202*i*, each signal having a respective pulse 204*a*-204*i*. The pulses 204*a*-204*i* received from the computing device 108 are relatively low voltage, for example, logic level voltage of less than 5V to 10V. The timing of the pulses 204*a*-204*i* on the nine signals are staggered by time spans much larger than the pulse width.

Figure 5:
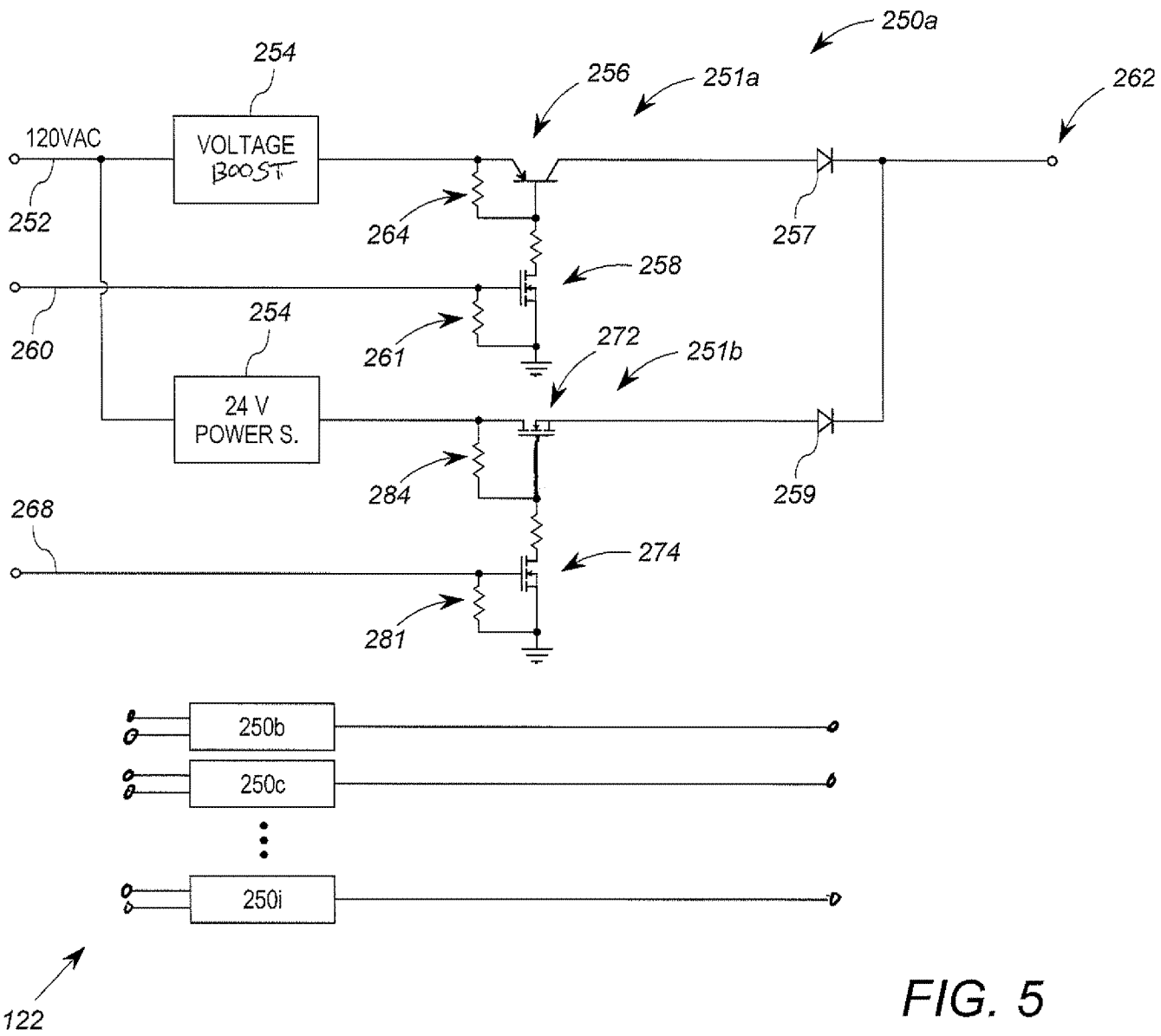
FIG. 5 shows a schematic diagram of an exemplary pulsed valve driver of the system of FIG. 1.

The pulsed valve driver 122 is configured to receive the nine signals 202*a*-202*i* and produce high voltage pulses that correspond in time and width to the pulses 204*a*-204*i*. For reasons discussed further below, the high voltage pulses have a magnitude of over 200V, and preferably about 300V, to ensure quick operation of the valves 134. The pulsed valve driver 122 is operably coupled to apply each of the generated high voltage pulses to a select, corresponding one of the valves 134. FIG. 5 shows a schematic diagram of an exemplary pulsed valve driver 122. In this embodiment, the pulsed valve driver 122 has nine pulse generating circuits 250*a*-250*i*, each configured to receive one of the nine signals 202*a*-202*i*, and generate the high voltage output pulse corresponding to the respective pulse 204*a*-204*i*. For reasons that will be discussed below, each of the nine pulse generating circuits 250*a*-250*i* is further configured to generate additional pulses of a lower voltage, for example approximately 24 volts. Each of the pulse generating circuits 250*a*-250*i* is operably coupled to receive AC mains power as well. Each pulse generating circuit 250*a*-250*i* is operably coupled to a corresponding one of the valves 134 of the multichannel valve assembly 120 of FIGS. 1 and 2.

While only the pulse generating circuit 250*a* is shown in detail, the other eight pulse generating circuits 250*b*-250*i* may suitably have the same structure. The pulse generating circuit 250*a* includes a high voltage pulse circuit 251*a*, a medium voltage (e.g. 24V) pulse circuit 251*b*, an AC power input 252, a pulse logic input 260, a hold pulse logic input 270, and a pulse output 262. The high voltage pulse circuit 251*a* is configured to receive the pulse 204*a* and generate the high voltage output pulse at the pulse output 262 responsive thereto. The medium voltage pulse circuit 251*b* is configured to receive a hold pulse signal, which is similarly a low voltage logic signal, and is configured to generate a corresponding medium voltage pulse at the pulse output 262 responsive thereto. The pulse output 262 is operably coupled to a select one of the valves 134 of FIGS. 1 and 2.

The high voltage pulse circuit 251*a* includes a voltage boost circuit 254, a first transistor switch 256, and a second transistor switch 258. The AC power input 252 is operably coupled to provide approximately 120 VAC to the voltage boost circuit 254. The voltage boost circuit 254 may take any suitable form known in the art that provides a rectified voltage of a magnitude larger than the magnitude of the input 120 VAC. By way of example, the boost circuit 254 could take a form based on known voltage doubler circuits. In any event, the voltage boost circuit 254 is operably connected to provide approximately 300 volts to the first transistor switch 256. In this embodiment, the first transistor switch 256 is a PNP bipolar junction transistor having its emitter coupled to receive the 300 volts from the voltage boost circuit 254. The collector of the first transistor switch 256 is operably coupled to the pulse output 262 via a diode 257.

The logic input 260 is operably coupled to the control terminal of the second transistor switch 258. In this embodiment, the second transistor switch 258 is an n-channel MOSFET having its gate coupled to receive the logic signal from the logic input 260. The gate of the MOSFET 258 is further coupled to ground via a high impedance resistor 261, for example 1 M-ohm. The source of the MOSFET 258 is coupled to ground, and the drain of the MOSFET 258 is operably coupled to the base of the first transistor switch 256. Thus, the control terminal (base) of the first transistor switch 256 is operably coupled to ground via the drain-source path of the MOSFET 258. The base and emitter of the first transistor switch 256 are coupled to each other via a resistor 264 of, for example, 100 ohms.

As discussed above, the medium voltage pulse generating circuit 251*b* in this embodiment is configured to receive a second "hold pulse" that causes the pulse generating circuit 250*a* to generate a different output voltage at the pulse output 262. In particular, the valves 134 in this embodiment are designed to open at a lower voltage, for example, 24 volts. However, the valves 134 open relatively slowly at that voltage, which is disadvantageous. Accordingly, the high voltage pulse generating circuit 251*a* is designed to deliver the high voltage pulse as described above to cause the valve 134 to open (actuated state). However, to protect the valve 134, it is not desirable to apply a high voltage pulse for more than a very short time, for example, a few hundred microseconds. Accordingly, if it is necessary to hold the valve 134 open for more than a very short time, then pulse generating circuit 250*a* removes the 300 V from the output pulse output 260 and applies the much lower nominal voltage for maintaining the valve 134 in the actuated state.

To this end, the medium voltage pulse generating circuit 251*b* includes a hold pulse logic input 268, a 24-volt power supply 270, a third semiconductor switch 272, and a fourth semiconductor switch 274. The AC power input 252 is operably coupled to provide approximately 120 VAC to the 24-volt power supply 270. The 24-volt power supply 270 may take any suitable form known in the art. The 24-volt power supply 270 is operably connected to provide approximately 24 volts DC to the third transistor switch 272. In this embodiment, the third transistor switch 272 is a p-channel MOSFET transistor having its source coupled to receive the 24 volts from the 24-volt power supply 270. The drain of the third transistor switch 272 is operably coupled to the pulse output 262 via another diode 259.

The second logic or hold pulse logic input 268 is operably coupled to the control terminal of the fourth transistor switch 274. In this embodiment, the fourth transistor switch 274 is an n-channel MOSFET having its gate coupled to receive the logic signal from the hold pulse logic input 268. The gate of the MOSFET 274 is further coupled to ground via a high impedance resistor 281, for example 1 M-ohm. The source of the MOSFET 274 is coupled to ground, and the drain of the MOSFET 274 is operably coupled to the gate of the third transistor switch 272. Thus, the control terminal (gate) of the third transistor switch 272 is coupled to ground via the drain-source path of the MOSFET 274. The source and gate of the third transistor switch 272 are coupled to each other via a resistor 284 of, for example, 10 k-ohms.

In the general operation of the pulse generating circuit 250*a*, the voltage boost circuit 254 receives 120 volts AC and provides approximately 300 volts to the emitter of the first transistor switch 256. The power supply 270 similarly receives 120 volts AC and provides 24 volts to the source of the third transistor switch 272. The logic input 262 is operably connected to receive the signal 202*a* from the computing device 108, and the hold pulse logic input 268 is operably coupled to receive a hold pulse logic signal, not shown, from the computing device 108. In the absence of a logic pulse (i.e. logic pulse 204*a*) at the input 260, the MOSFET 258 has zero voltage at its gate, and it does not conduct drain to source. Accordingly, the base of the first transistor switch 256 is at the emitter voltage of approximately 300 volts (via resistor 264), which is insufficient for the emitter-base diode of the first transistor switch 256 to turn on. Thus, the first transistor switch 256 does not conduct from emitter to collector, and no voltage can propagate to the pulse output 262 from the first transistor switch 256.

Similarly, in the absence of a logic pulse at the hold pulse logic input 268, the MOSFET 281 has zero voltage at its gate, and it does not conduct drain to source. Accordingly, the gate of the third transistor switch 272 is at the source voltage of approximately 300 volts (via resistor 284), and the switch 272 is nonconductive from source to drain. Thus, no voltage can propagate to the pulse output 262 from the switch 272.

When the logic pulse 204*a* occurs at the pulse input 260, the MOSFET 258 has sufficient voltage to turn on. When the MOSFET 258 conducts drain to source, the base of the first transistor switch 256 is pulled down, thereby causing a sufficient differential to allow the emitter-base diode of the first transistor switch 256 to turn on. As a result, the first transistor switch 256 conducts emitter to collector, and the 300 volts appears at the pulse output 262. After the pulse 204*a* is concluded, the MOSFET 258 and first transistor switch 256 turn off again, and the emitter voltage of the first transistor switch 256 no longer appears at the pulse output 262. Accordingly, the high voltage pulse circuit 251*a* in this embodiment receives a logic pulse, which will typically be under 10 volts, and generates a pulse of 300 volts. The 300 volt pulse is employed because it can open the valve 134 quickly to ensure correct delivery of the reagent.

When a hold pulse appears at the hold pulse logic input 268, the MOSFET 274 has sufficient voltage to turn on. When the MOSFET 274 conducts drain to source, the gate of the third transistor switch 272 is pulled low, thereby causing the third transistor switch 272 to turn on. As a result, the third transistor switch 272 conducts source to drain, and the 24 volts appears at the pulse output 262. After the hold pulse is concluded, the MOSFET 274 and third transistor switch 272 turn off again, and the source voltage of the third transistor switch 272 no longer appears at the pulse output 262. Accordingly, the medium voltage pulse circuit 251*b* receives a logic pulse, which will typically be under 10 volts, and generates a pulse that is lower than the high voltage pulse circuit 251*a*, which is configured to hold open a valve that has already been opened via the high voltage pulse. The medium voltage pulse is optionally employed because it can hold the valve open for a longer period at a lower voltage, if necessary.

If a pulse is present on both the pulse input 260 and the hold pulse logic input 268, then the pulse generating circuit 250*a* only delivers the high voltage pulse to the pulse output 262. To this end, the diodes 257 and 259 operate as an analog "or" gate. In particular, in such a case, the high voltage pulse generating circuit 251*a* provides a high voltage to the pulse output 262 to the diode 257, and the medium voltage pulse generating circuit 251*b* provides the lower 24 volts to the diode 259. Because the cathodes of the diodes 257, 259 are coupled at the pulse output 262, the high voltage of the high voltage pulse generating circuit 251*a* reverse biases the diode 259, and thus the output of the medium voltage pulse generating circuit 251*b* cannot propagate through the diode 259 to the pulse output 262.

It will be appreciated that in some embodiments, the medium pulse generating circuit 251*b* is not necessary because the high voltage pulses are sufficient for reagent delivery. Additionally, it will also be appreciated that the high voltage pulse generating circuit 251*a* can take other known forms. For example, the voltage boost circuit 254 is not necessary if a higher (e.g. 240 AC) voltage is provided as a circuit input (a simple rectifier circuit could be used). The voltage boost circuit 254 also is not necessary if a transformer were employed to boost the 120 volt signal. In some embodiments, a valve 134 could be employed that does not require a high voltage pulse to open adequately. In such a case, suitable circuits are known that can generate such alternative pulses, based on a logic pulse, using AC mains power. Nevertheless, it has been found that the use of a high voltage pulse of at least 200 volts and preferably 300 volts, provides valve operation.

The other pulse generating circuits 250*b*-250*i* generate high voltage pulses responsive to receiving the respective logic pulses 204*b*-204*i*, and optionally, respective medium voltage hold pulses, in the same manner.

Figure 6:
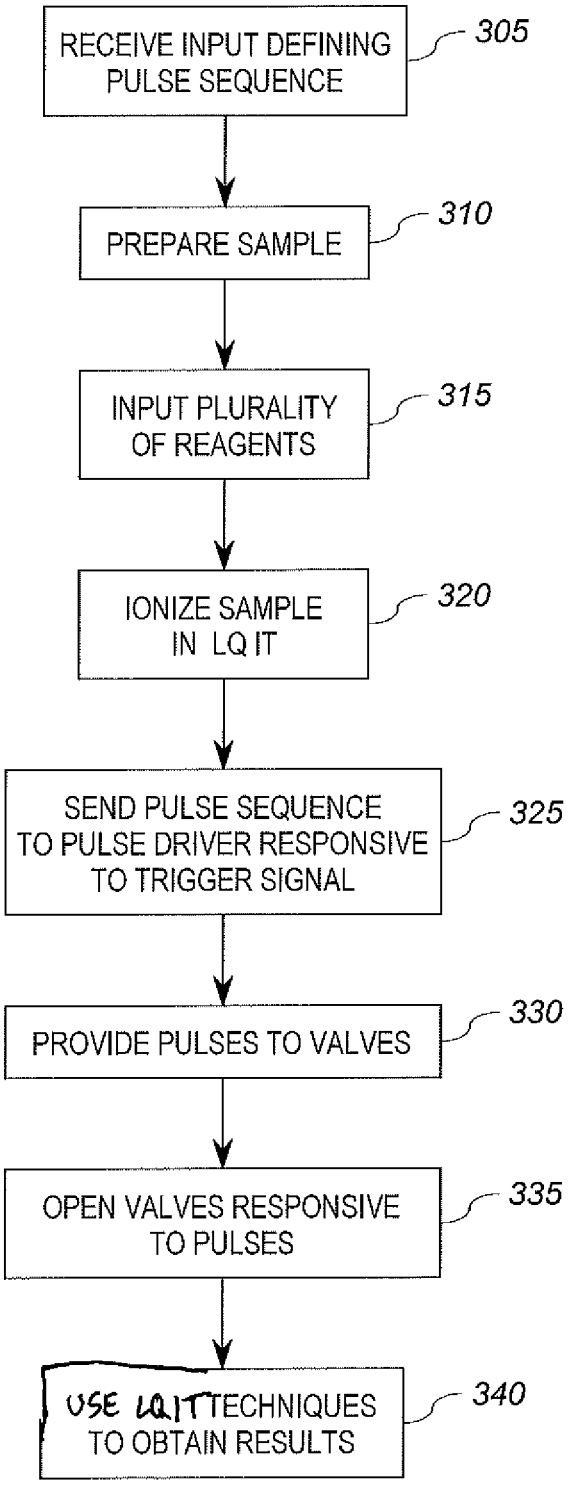
FIG. 6 shows a method of operating the mass spectrometry system of FIG. 1.

FIG. 6 shows a method of operating the mass spectrometry system 100 of FIG. 1, which incorporates a method of providing multiple reagents to an ion trap in accordance with embodiments described herein.

Figure 7:
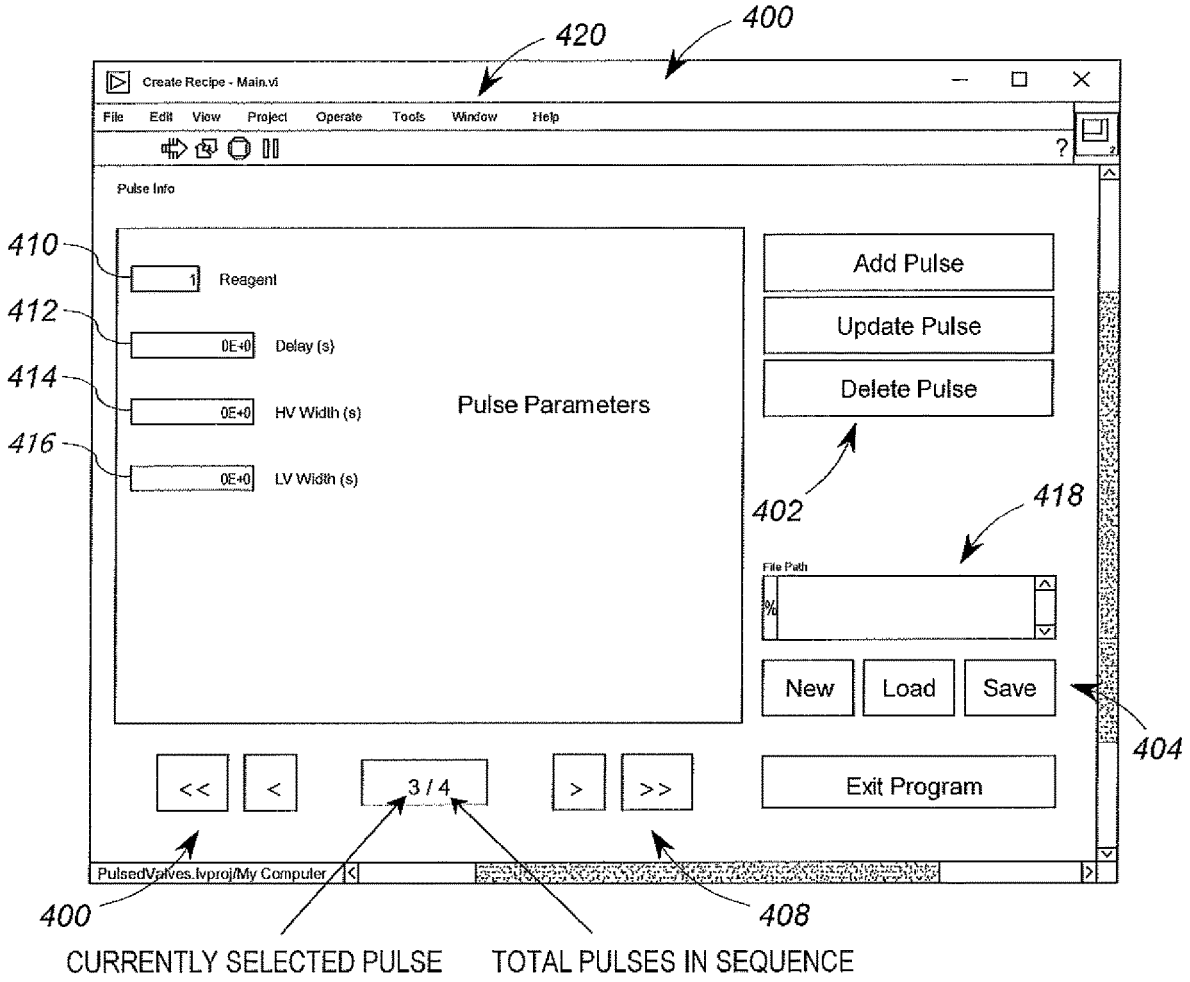
FIG. 7 shows representation of an interactive graphical user interface screen used to define pulse sequences in the computing device of FIG. 1.

In step 305, the computing device 108 receives input defining a sequence of output pulses. In this example, the processor 108*a* receives the input, provided by a user, via the graphical user interface 109. The input data defines the number and sequence of valves 134 to be opened. The input also defines the duration of the pulse and the timing between consecutive pulses. FIG. 7 shows an interactive GUI screen 400 that may be generated by the processor 108*a* and displayed via the display 108*e* of the GUI 109. As shown in FIG. 7, the screen 400 includes interactive pushbutton widgets 402, 404, 406, that allow for input by the user, via control of an input device, such as a mouse, touchscreen, or other selection device. The screen 400 also includes text boxes 410, 412, 414, 416 and a menu-selection box 418, as well as traditional toolbar pull down menus 420.

Referring to FIG. 7, the screen 400 allows for creation and/or editing of a particular sequence file. The display in general allows data entry for a single pulse event of the pulse sequence, via the text boxes 410, 412, 414, 416. A display box 408 shows the current pulse event definition. For example, in this exemplary display, four pulse events have been defined for the pulse sequence, and the third pulse event in that sequence is being displayed. The widgets 402 allow the user to add, update or delete a pulse from the sequence. The widgets 404 allow the pulse sequence data files to be saved, loaded or created. The widgets 406 allow the user to navigate to different pulses within the currently defined sequence.

The text box 410 allows entry of a reagent identifier. This identifier tracks to a specific one of the valves 134 of the multichannel valve assembly 120 of FIG. 2, and thus to a specific one of the pulse generating circuits 250*a*-250*i*. The pulse event being displayed defines when, and for what duration, that particular valve 134 will be in the actuated state. The text box 412 allows for the entry of the time between the prior pulse, and the pulse being defined on the screen. The text boxes 414, 416 allow for the entry of, respectively, the high voltage pulse and medium voltage pulse duration.

Figure 8:
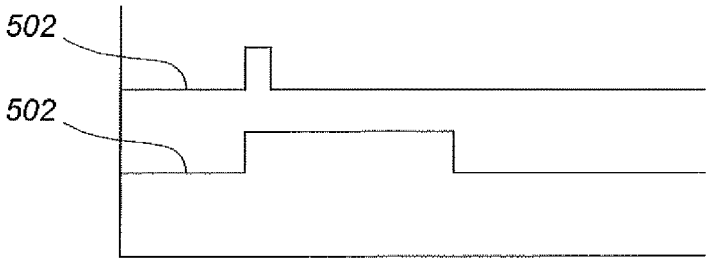
FIG. 8 shows a representative timing diagram of a single pulse event that includes both a high voltage logic pulse and a medium voltage logic hold pulse.

As discussed above, each pulse event may have more than one voltage level—a high voltage (e.g. >200V) pulse to initiate the opening of the valve 134, and a lower voltage (e.g. 24V) pulse to hold the valve 134 in the open position past the duration of the high voltage pulse. Accordingly, each "pulse" event can result in a high voltage pulse logic signal (which is provided, for example, to the logic input 260 of FIG. 5), and medium voltage pulse logic signal (which is provided, for example, to the logic input 268 of FIG. 5). FIG. 8 shows a representative timing diagram of a single pulse event that includes both a high voltage logic pulse 502, and a medium voltage logic pulse 504. The processor 108*a* is configured and operably coupled to provide pulses 502, 504 to respective inputs (e.g. inputs 260, 268) of a select one of the pulse generating circuit 250*a*-250*i*, corresponding to the reagent identifier.

Via the GUI 109 and screen 400, a valve pulse sequence is defined. Optionally, the sequence may have up to nine pulse events, each having a high voltage pulse portion and a medium voltage hold pulse portion. The user may save the defined sequence via the widgets 404 for later use, and/or may retrieve previously defined sequences via the widgets 404. The stored sequences in any event may be stored in the memory 108*b*, which is readily accessible by the processor 108*a*.

Referring again to FIG. 6, in step 310, a sample to be analyzed by the system 100 is prepared within the source 106. Known methods for prepare LQIT samples for ion/molecule reactions are known in the art. In step 315, the neutral reagents that are required to induce the ion/molecule reactions in the LQIT are introduced into valve assemblies 124 via the injection ports 132. The neutral reagents are introduced into select valve assemblies 124 in conjunction with the defined pulse sequence in the memory 108*b*, such that the sequence of pulses opens a known sequence of valves 134, and causes a known sequence of neutral reagents to be pulsed into the ion trap 110. The first valve 134 and second valve 140 of each valve assembly 124 are closed, thereby retaining the injected neutral reagent in the reagent chamber 142. In step 320, the sample is introduced into the ion source 106 and is ionized and transferred into the ion trap 110. As is known in the art, the ion of interest is furthermore isolated from the other ions that were co-introduced into the ion trap 110.

Thereafter, in step 325, the pulse sequence is initiated and provided to the pulsed valve driver 122. To this end, the processor 108*a* receives a trigger signal. The trigger signal may be manual, entered via the GUI 109 by a user. In an alternative, the trigger signal may be received from an external source. For example, circuitry associated with the operation of the ion trap 110, PDA detector 114 or auto sampler 116 can generate analog or digital logic signals indicating compound ionization within the ion trap. Such a logic signal can be communicated to the processor 108*a*. The processor 108*a* may then use the compound ionization signal as a trigger signal to start the pulse sequence. In some embodiments, the processor 108*a* receives only an analog or digital signal representative of the ionization level, and performs peak detection to generate the trigger signal. Other external signals relating to the operation of the mass spectrometer 102 may also be used as trigger signals.

In any event, once the trigger signal is received, the processor 108*a* is programmed to deliver pulses to one or more of the pulse generating circuits 250*a*-250*i* in accordance with the defined pulse sequence (e.g. FIG. 4). Some or all of the pulse generating circuits 250*a*-250*i* may in some cases receive both a high voltage pulse logic signal (e.g. signal 502) and a medium voltage pulse logic signal (e.g. signal 504). However, many analysis operations do not require the medium voltage "hold pulse" signal. Accordingly, FIG. 4 demonstrates a typical pulse sequence for nine valves, which does not include any medium voltage pulse logic signals.

With reference to the example of FIG. 4, the processor 108*a* provides to each of the pulse generating circuits 250*a*-250*i* a corresponding signal 202*a*-202*i* with logic pulses 204*a*-204*i* in accordance with a select stored sequence. The stored pulse sequence may suitably be sequence generated using the GUI 109 on the screen 400 of FIG. 7 discussed above in connection with step 305. It will be appreciated that the pulse sequence defined in step 305 and delivered in step 325 may have fewer than nine pulses, and may only use some of the valves 134.

In step 330, each of the pulse generating circuits 250*a*-250*i* generates a high voltage pulse (>200V) responsive to receiving a corresponding logic pulse 204*a*-204*i*. Each of the pulse generating circuits 250*a*-250*i* in this example provides the high voltage pulse to a corresponding valve 134.

In step 335, each valve 134, upon receiving a high voltage pulse, actuates (i.e. opens) to provide a fluid connection between the reagent chamber 142 and the ion trap 110 via the manifold 128. The lower pressure within the ion trap 110 causes the reagent to flow from the reagent chamber 142 to the ion trap 110 to facilitate the desired gas-phase ion/molecule reactions. At the completion of each high voltage pulse, the corresponding valve 134 closes (de-actuates). As a result of this operation, a plurality of reagents (in this example, nine) in a plurality of reagent chambers 142 are pulsed into the ion trap in the predefined sequence. In step 340, known LQIT techniques are employed to analyze and record the sample ion and neutral reagent reactions.

Additionally, during and between pulses, the variable leak valve 126 introduces a constant flow of helium through the manifold 128 to help clear the reagent from the manifold 128 (and ion trap 110) before the next reagent was pulsed in.

After the ion/reagent reactions are analyzed and completed, the second valves 140 can be opened. As a result, lower pressure from the rough pump 118 can pump any remaining reagent out of the reagent chambers 142. If it is desired to remove or replace a valve assembly 124 for any reason, the plunger 130 is actuated into the center of the manifold 128, which seals the ion trap 110 from all of the ports 154, 155 on the manifold 128 that connect to the valve assemblies 124 (and variable leak valve 126). The select valve assemblies 124 may be removed or replaced thereby without breaking the vacuum in the ion trap 110. After replacement or capping, the plunger can be deactuated such that a path is restored between the ion trap and the remaining valve assemblies 124, the variable leak valve 126.

Provided below are discussions of a number of exemplary experiments performed on the system 100 of FIG. 1, including results thereof.

Experimental Operation

The chemicals used in the experiments included 2-methoxypropene, dimethyl disulfide, diethylmethoxyborane, trimethyl borate, dimethyl ketone, trichlorosilane, trimethoxymethylsilane, tris(dimethylamino)borane, benzhydroxamic acid, glycyl-glycine, hexanoic acid, 4-hydroxybenzenesulfonamide, nitrosobenzene, benzoic acid, and dimethyl sulfone, obtained from Sigma-Aldrich (St. Louis, Mo., USA). Dimethylamine dissolved in methanol was obtained from Tokyo Chemical Industry Co., Ltd. (Portland, Oreg., USA), carvedilol N'-β-D-glucuronide was obtained from Toronto Research Chemicals (Toronto, Ontario, Canada), and albendazole sulfoxide was obtained from Santa Cruz Biotechnology (Dallas, Tex., USA). Liquid chromatography/mass spectrometry (LC/MS) grade water and acetonitrile were obtained from Fisher Scientific (Pittsburgh, Pa., USA). All chemicals were used as received.

The studies were conducted on a Thermo Scientific LQIT mass spectrometer 102 (LTQ, Thermo Scientific, San Jose, Calif., USA) equipped with an APCI source 106 and an ESI source 106 operated in both positive and negative ion modes, as discussed in Schwartz, J. C.; Senko, M. W.; Syka, J. E. P. A Two-Dimensional Quadrupole Ion Trap Mass Spectrometer. *J. Am. Soc. Mass Spectrom.* 2002, 13 (6), 659-669.

The mass spectrometer 102 was coupled with a Thermo Surveyor Plus HPLC system that included a HPLC pump 112, autosampler 116, and PDA detector 114. The instrument operated on Xcalibur 2.2 and LTQ Tune software.

For direct injection experiments, samples were prepared in methanol at a concentration of 1.0 mg/mL and were introduced directly into the ion source through a syringe drive at a rate of 25 μL/min. With the ESI source, a 50/50 (v/v) methanol/water solvent mixture was tee-infused with the analyte sample at a rate of 100 μL/min by using a Thermo Scientific Surveyor MS Pump Plus to stabilize the ESI spray. The APCI source conditions were as follows: 300° C. vaporizer temperature, 275° C. capillary temperature, 30 arbitrary units sheath gas ($N_2$) flow, 10 arbitrary units auxiliary gas ($N_2$) flow, and a 4.0 kV discharge voltage maintained with a 5.0 μA discharge current. The ESI source conditions were the following: 275° C. capillary temperature, 30 arbitrary units sheath gas ($N_2$) flow, 10 arbitrary units auxiliary gas ($N_2$) flow, and a 2.0 μA spray current maintained with a 4.0 kV spray voltage. The capillary voltage, tube lens voltage and voltages for the ion optics were optimized using the automated tuning feature of the instrument, LTQ Tune Plus, for the low mass range from m/z 15 to m/z 200 and for the normal mass range from m/z 50 to m/z 500 for both ion sources.

For HPLC-MS experiments, samples were injected via an auto-sampler using partial loop injection (10 μL). The mobile phase solvents used were water (A) and acetonitrile (B), both containing 0.5% (w/v) ammonium formate to encourage protonation and enhance HPLC resolution. The column used was a ZORBAX SB-C18 (4.6×250 mm, 5 μm particle size) column purchased from Agilent Technologies (Santa Clara, Calif., USA). The eluate was subsequently ionized and the analyte ions were isolated and allowed to react with the neutral reagent(s) for 30 ms.

Results and Discussion

The goal of this study was to design, build, and test a nine-pulsed valve inlet system 104 that allows examination of gas-phase ion/molecule reactions involving several different reagents on a HPLC separation time scale. Neutral reagents were introduced into the trapping region of the mass spectrometer 102 via this new pulsed valve inlet system 104 using the methods described generally above.

Each pulsed valve stem (valve assembly 124) was constructed with a two-way valve 140, a tee-connector with an Ultra-Torr fitting that housed a rubber septum (injection port 132), and a Series 9 pulsed valve (Parker Hannifin, Cleveland, Ohio, USA) that had an exit orifice of 0.060 inch (first valve 134). The plunger 130 allowed for the easy removal of each valve assembly 124 without the need to vent the instrument 102, 110 during maintenance of the pulsed valves 134. When the plunger 130 is pressed in, all nine pulsed valve assemblies 124 are blocked off from the instrument 102, 110. This allows each stem to be removed from the manifold 128 without breaking the instrument's vacuum.

A Granville-Phillips Series 203 variable leak valve 126 (MKS Instruments, Andover, Mass., USA) introduced a constant flow of helium through the manifold wheel 144. Neutral reagents were introduced into each pulsed valve assembly 124 by injection of ~5 μL of a pure regent via a syringe through the injection port 132.

A custom program used to build pulse sequences was developed using the LabVIEW platform (National Instruments, Austin, Tex., USA) by the Jonathan Amy Facility for Chemical Instrumentation (JAFCI, Purdue University, West Lafayette, Ind., USA). The open-time of each pulsed valve 134 and the time delay between the pulses were entered into the program. The LabVIEW program allowed the generation of nine channels (A-I), one for each pulsed valve (A-I). A typical pulse sequence is depicted in FIG. 4 for the open-time of all nine pulsed valves.

The operations of the processor 108*a* were in this embodiment implemented as a LabVIEW program. The pulse generator 122 had an output of approximately 300 V to each pulsed valve 134 according to the sequence set in the LabVIEW program. The pulsed valves 134 were triggered manually via the LabVIEW program or automatically by using a signal obtained from the mass spectrometer 102. For automatic triggering, a signal was obtained from the digital board, not shown, of the instrument 102 upon execution of an experimental event, such as ion isolation, activation, or scan out. Any of these events can be selected as a trigger from the LTQ Tune Plus software. This signal was sent to the processor 108*a* running the LabVIEW program, and responsive to which the pulse sequence.

The reagents where introduced into the mass spectrometer sequentially, consistent with the pulses shown in FIG. 4. A one-second delay was placed into the sequence prior to the opening of the first pulsed valve (A). This was done so that if the sequence was repeated, there would be a one-second delay between closing the last pulsed valve in the end of a sequence and opening the first pulsed valve in the beginning of a new sequence. As shown in FIG. 4, the open time was defined by the pulse time, 150 μs, that was set in the LabVIEW program using the GUI 109 and via screen 400. A one-second delay was used between opening each pulsed valve. This allowed time for the reagents to be pumped out of the ion trap before the next reagent was introduced. Upon manual triggering, the pulse sequence ended after the last pulsed valve was closed. However, in automatic triggering, the sequence is repeated until the experimental event has concluded.

The most important aspect that needed to be addressed was the residence time of each reagent in the trapping region of the LQIT mass spectrometer 102. This is the main factor that determines the number of reagents that can be used in the pulsed valve system 104 during a HPLC separation. Ideal reagents being used in the pulsed valve system 104 should be reasonably volatile. Each reagent needs to be pumped out from the instrument 102 prior to the introduction of the next reagent.

It has been found that reduction of the time a reagent stays in the ion trap 110 was accomplished via the use of the high voltage pulsed valve driver 122, the shortened travel distance between the pulsed valves 134 and the entrance into the vacuum region 110 facilitated by the manifold 128, and the variable leak valve 126 that supplied helium through the manifold wheel 144. The high voltage pulsed valve driver supplied approximately 300 V to each pulsed valve. This allowed the valves to open and close much faster than in the previously published three-pulsed valve device, thus the amount of reagent pulsed into the mass spectrometer was more controllable. Also, since the tubing connecting the pulsed valve 134 to the interface of the instrument was shortened in the system 104, the amount of dead space was reduced, which enabled the reagent to enter the mass spectrometer 102 faster. Under normal operating conditions, the ion gauge of the instrument read approximately $0.70\times10^{-5}$ Torr but was increased and maintained at $1.75\times10^{-5}$ Torr with the addition of helium flowing through the manifold wheel 144. As the pulsed valve 134 was opened and then closed, diffusion of the reagent through the tubing was slowed down as the pulsed valve 134 was closed. With helium from the variable leak valve 126 flowing through the manifold wheel 144, the reagent was carried along the helium stream and into the instrument 102.

Figures 9A, 9B, 9C:
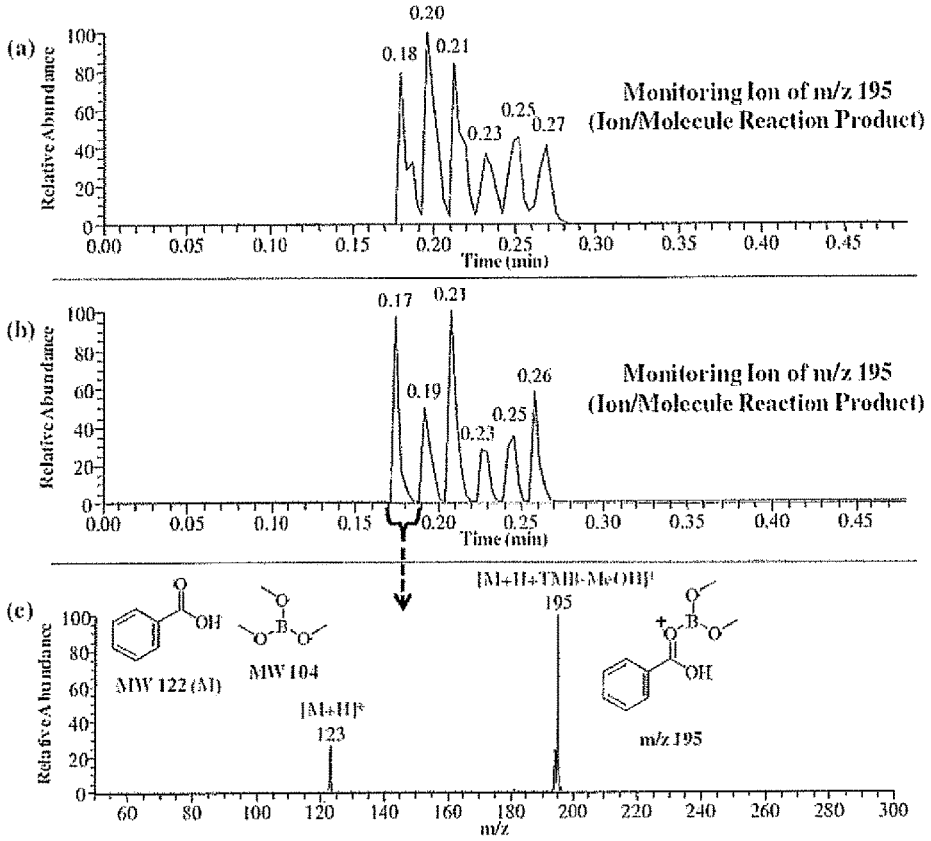
FIG. 9*a* shows a mass chromatogram monitoring the current of the product ion (m/z 195) as TMB was pulsed into an LQIT using the system of FIG. 1 without flow of helium.
FIG. 9*b* shows a mass chromatogram monitoring the current of the product ion (m/z 195) as a constant flow of helium was introduced.
FIG. 9*c* shows an MS/MS spectrum measured for the reaction of TMB with protonated benzoic acid generated in the system of FIG. 1.

Trimethyl borate (TMB) was used to compare the residence time of a reagent in the ion trap when using a previous pulsed-valve system and the nine-pulsed valve system 104 disclosed herein. For the previously used pulsed valve system, TMB was observed to remain in the instrument for approximately 6 seconds. To test the new system, benzoic acid was injected into an APCI source and protonated. TMB was loaded into one of the pulsed valve assemblies or stems 124 and was manually triggered 6 times with a 1 second delay between each pulse by using the LabVIEW program. An optimal pulse time of 110 μs was determined for the reagent TMB. The experiment was performed twice, once without helium flowing through the manifold wheel of the pulsed valve assembly and another time with helium. This was performed to determine whether helium has an effect on the residence time. FIGS. 9*a* to 9*c* show the results.

FIG. 9*a* shows a mass chromatogram monitoring the current of the product ion (m/z 195) as TMB was pulsed into the instrument 102 and allowed to react with protonated benzoic acid. TMB was pulsed into the instrument 102 six times with a one-second delay between each pulse. A constant flow of helium was not introduced through the manifold wheel of the pulsed valve assembly. FIG. 9*b* shows a mass chromatogram monitoring the current of the product ion (m/z 195) as a constant flow of helium was introduced through the manifold wheel of the pulsed valve assembly. FIG. 9*c* shows an MS/MS spectrum measured for the reaction of TMB with protonated benzoic acid. The residence time of TMB was found to be 1.2 seconds without the use of helium and 0.9 seconds with the use of helium.

As seen in FIGS. 9*a*-9*c*, when TMB was pulsed into the LQIT 110, it reacted with protonated benzoic acid and a product ion corresponding to a TMB adduct that has lost a methanol molecule ($[M+H+TMB-MeOH]^+$) was observed. The current of the product ion (m/z 195) was monitored over time as TMB was pulsed into the instrument, as shown in FIGS. 9*a* and 9*b*. The signal corresponding to the product ion increased during each reagent pulse but dropped once the reagent was fully pumped away. It was also observed that helium flowing through the manifold wheel 144 affected the residence time of the reagent. As seen in FIG. 9*a*, without the use of helium, it took approximately 1.2 seconds for TMB to be fully pumped away. When helium was used, the residence time of TMB was about 0.9 seconds, which corresponds to a 25% improvement. More importantly, the residence time in the new pulsed valve set-up was only 0.9 seconds compared to the 6 seconds observed for the old system.

To ensure that the delay time after a reagent was pulsed into the ion trap 110 was long enough before the introduction of a new reagent, the residence time of each reagent being used was determined. The reagents included 2-methoxypropene (MOP), dimethyl disulfide (DMDS), diethylmethoxyborane (DEMB), trimethoxymethylsilane (TMMS), dimethyl ketone (DMK), tris(dimethylamino)borane (TDMAB), dimethylamine (DMA), and trichlorosilane ($HSiCl_3$). Following the same procedure used to obtain the residence time of TMB, the above reagents were allowed to react with protonated or deprotonated compounds that are known to produce a unique product ion with the reagent. MOP, DMDS, DEMB, TMMS, DMK, TDMAB, DMA, and $HSiCl_3$ were allowed to react with protonated benzhydroxamic acid, nitrosobenzene, hexanoic acid, dimethyl sulfone, glycyl-glycine, albendazole sulfoxide, 4-hydroxybenzenesulfonamide, and deprotonated carvedilol N'-β-D-glucuronide, respectively. The majority of the reagents resided in the ion trap for less than 1 second with the exception of DMA, which resided in the ion trap for approximately 4 seconds. The residence time of each reagent is summarized in Table 1.

TABLE 1

| Reagent (MW) | Analyte (MW) | Residence Time of the Reagent (s) |
|---|---|---|
| 2-Methoxypropene (72) (MOP) | Benzhydroxamic acid (137) | 0.8 |
| Dimethyl disulfide (94) (DMDS) | Nitrosobenzene (107) | 0.8 |
| Diethylmethoxyborane (100) (DEMB) | Hexanoic acid (116) | 0.6 |
| Trimethyl borate (104) (TMB) | Benzoic acid (112) | 0.9 |
| Trimethoxymethylsilane (136) (TMMS) | Dimethyl sulfone (94) | 0.9 |
| Trichlorosilane (134) ($HSiCl_3$) | Carvedilol N'-β-D-glucuronide (582) | 0.9 |
| Dimethyl ketone (58) (DMK) | Glycyl-glycine (132) | 0.9 |
| Tris(dimethylamino)borane (143) (TDMAB) | Albendazole sulfoxide (281) | 0.6 |
| Dimethylamine (45) (DMA) | 4-Hydroxybenzene-sulfonamide (173) | 4.0 |

Knowing the residence time of each reagent allowed for optimization of the pulse/delay sequence. Since the majority of the reagents remained in the ion trap for less than 1 second, the sequence depicted in FIG. 4 could be used to introduce all nine reagents consecutively in an experiment. If the sequence depicted in FIG. 4 was to be repeated continuously, like it would be during automatic triggering, the delay time after DMA is pulsed into the mass spectrometer would have to be increased from 1 second to 4 seconds to allow time for DMA to be pumped out.

The sequence depicted in FIG. 4 was triggered manually in an ion/molecule reaction experiment. The nine reagents were allowed to react with protonated benzoic acid as each reagent was sequentially pulsed into the mass spectrometer 102. The reagents were loaded in the following order: MOP, DMDS, DEMB, TMB, TMMS, $HSiCl_3$, DMK, TDMAB, and DMA in pulsed valve positions A-I, respectively. From the list of reagents being used, only DEMB, TMB, and TMMS formed MS/MS product ions unique for protonated carboxylic acids (Table 2). Proton transfer, adduct formation, and/or no reactions have been observed for MOP, DMDS, TDMAB, and DMA. $HSiCl_3$ and DMK are reagents specific for the differentiation of O- and N-glucuronides and probing the structures of peptides, respectively. Reactions of these two reagents and protonated carboxylic acids have not been studied.

After isolating protonated benzoic acid (m/z 123), the nine reagents where sequentially pulsed into the ion trap 110 according to the sequence in FIG. 4 and reagent order described above. Only the reagents that were known from previous studies to react with protonated carboxylic acids (DEMB, TMB, and TMMS) produced unique MS/MS ion/molecule reaction product ions upon reactions with protonated benzoic acid. DEMB formed the MS/MS product ions $[M+H+DEMB-MeOH]^+$ and $[M+H+DEMB-MeOH+DEMB-MeOH]^+$. TMB and TMMS produced the MS/MS product ions $[M+H+TMB-MeOH]^+$ and $[M+H+TMMS-MeOH]^+$, respectively.

Figure 10A:
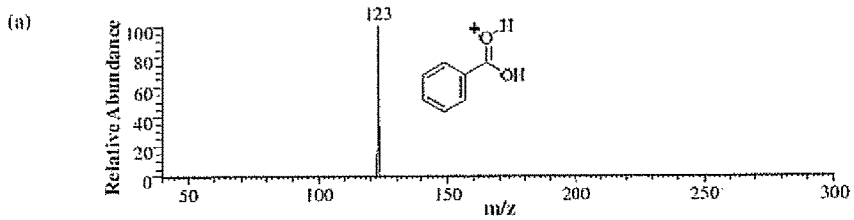
FIG. 10*a* shows an MS/MS spectrum of isolated protonated benzoic acid (m/z 123) ionized via APCI in the system of FIG. 1.
Figure 10B:
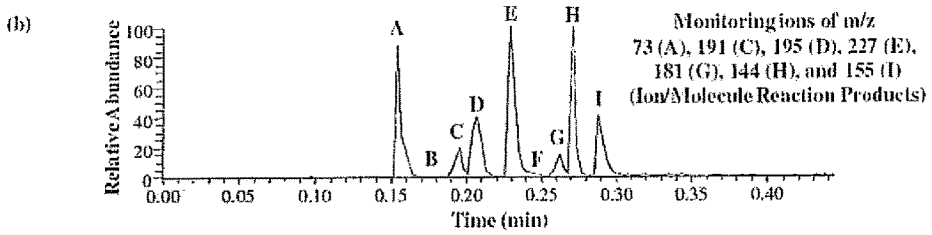
FIG. 10*b* shows a mass chromatogram monitoring the current of the product ions as (A) MOP, (B) DMDS, (C) DEMB, (D) TMB, (E) TMMS, (F) $HSiCl_3$, (G) DMK, (H) TDMAB, and (I) DMA were sequentially pulsed into the ion trap of the system of FIG. 1.
Figure 10C:
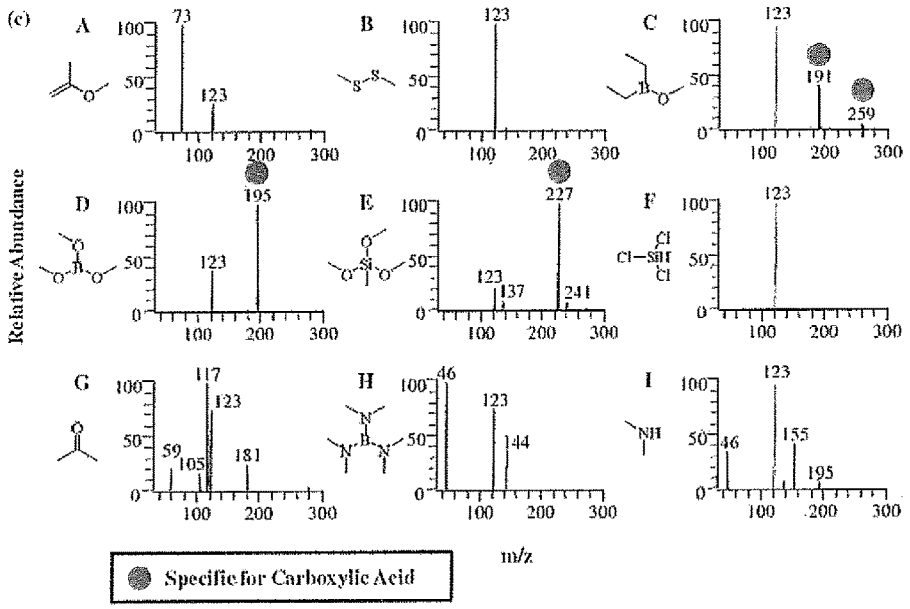
FIG. 10*c* shows MS/MS spectra measured after isolation and reaction of protonated benzoic acid with the neutral reagents.

FIG. 10*a* shows an MS/MS spectrum of isolated protonated benzoic acid (m/z 123) ionized via APCI. FIG. 10*b* shows a mass chromatogram monitoring the current of the product ions (m/z 73, 191, 195, 227, 181, 144, and 155) as (A) MOP, (B) DMDS, (C) DEMB, (D) TMB, (E) TMMS, (F) $HSiCl_3$, (G) DMK, (H) TDMAB, and (I) DMA were sequentially pulsed into the LQIT in the order from 204*a* to 204*i* in FIG. 4, and were allowed to react with protonated benzoic acid. FIG. 10*c* shows MS/MS spectra measured after isolation and reaction of protonated benzoic acid with the neutral reagents. A-I represents the pulsed valve positions corresponding to logic pulses 204*a* to 204*i*. Unique MS/MS product ions specific for the carboxylic acid functionality are highlighted with a darkened circle.

A summary of the observed product ions formed during ion/molecule reactions with the nine reagents and protonated benzoic acid are shown in Table 2.

TABLE 2

| Pulsed valved position | Reagent (MW) | Observed MS/MS product ions (m/z) upon reactions with benzoic acid |
|---|---|---|
| A | 2-Methoxypropene MOP (72) | Protonated MOP (73) |
| B | Dimethyl disulfide (DMDS) (94) | No Reaction Products |
| C | Diethylmethoxyborane (DEMB) (100) | DEMB Adduct-MeOH* (191)<br>DEMB Adduct-MeOH + DEMB-MeOH* (259) |
| D | Trimethyl borate TMB (104) | TMB Adduct-MeOH* (195) |
| E | Trimethoxymethylsilane TMMS (136) | Protonated TMMS (137)<br>TMMS Adduct-MeOH* (227) |
| F | Trichlorosilane $HSiCl_3$ (134) | No Reaction Products |

TABLE 2-continued

| Pulsed valved position | Reagent (MW) | Observed MS/MS product ions (m/z) upon reactions with benzoic acid |
|---|---|---|
| G | Dimethyl ketone DMK (58) | Protonated DMK (59) DMK Dimer (117) DMK Adduct (181) |
| H | Tris(dimethylamino)borane TDMAB (143) | Protonated DMA (46) Protonated TDMAB (144) |
| I | Dimethylamine DMA (45) | Protonated DMA (46) MeOH Adduct (155) |

*MS/MS product ions specific for the carboxylic acid funtionality.

The above-described experiment demonstrates the use of multiple reagents for the identification of a specific functionality.

Manual introduction of the reagents is suitable when a single analyte is being analyzed. However, for complex mixtures eluting from a HPLC, the ability to automatically trigger the pulsed valves is advantageous. As discussed above, the processor 108*a* is configured to automatically start the pulse sequence (e.g. FIG. 4) based on a trigger signal. One such trigger signal was obtained by selecting a trigger event in the LTQ Tune Plus software. The trigger event used here was ion isolation. After ion isolation, the isolated ion was allowed to react with the introduced reagent(s) for 30 ms. Upon isolation of an ion, a signal from the LQIT mass spectrometer was received by the LabVIEW software (executed by the processor 108*a*) that then initiated the pulse sequence that was entered into the program via the GUI 109. The processor 108*a* repeated the pulse sequence until the experimental event (ion isolation followed by a 30 ms reaction time) was completed. The experimental event continued until the analyte eluting from the HPLC was completely gone.

Figures 11A, 11B, 11C:
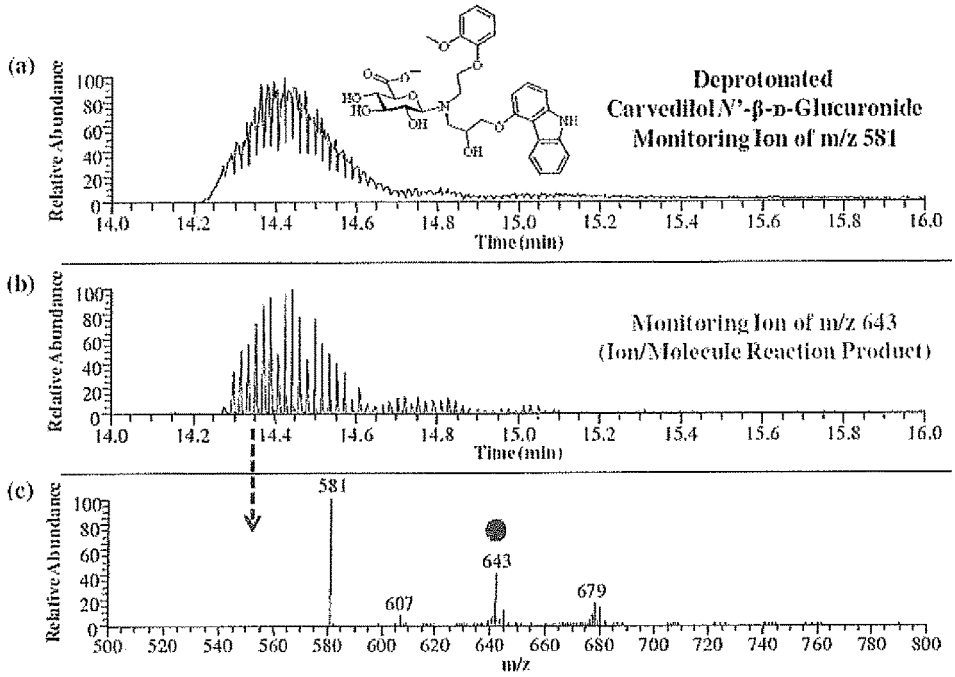
FIG. 11*a* shows an HPLC/MS chromatogram monitoring the extracted ion current of deprotonated carvedilol N'-β-D-glucuronide (m/z 581) using the system 100 of FIG. 1.
FIG. 11*b* shows an HPLC/MS chromatogram monitoring the extracted ion current for the diagnostic product ion $[M-H+HSiCl_3-2HCl]^-$ (m/z 643) formed as $HSiCl_3$ was pulsed into the ion trap 100 according to at least one embodiment described herein.
FIG. 11*c* shows an MS/MS spectrum measured for the reaction of $HSiCl_3$ with deprotonated carvedilol N'-β-D-glucuronide.

Automatic triggering was demonstrated with the reaction between $HSiCl_3$ and deprotonated carvedilol N'-β-D-glucuronide. To this end, FIGS. 11*a* to 11*c* illustrate reactions of $HSiCl_3$ with deprotonated carvedilol N'-β-D-glucuronide as it eluted from an HPLC. FIG. 11*a* shows an HPLC/MS chromatogram monitoring the extracted ion current of deprotonated carvedilol N'-β-D-glucuronide (m/z 581). FIG. 11*b* shows an HPLC/MS chromatogram monitoring the extracted ion current for the diagnostic product ion $[M-H+HSiCl_3-2HCl]^-$ (m/z 643) formed as $HSiCl_3$ was pulsed into the ion trap and allowed to react with deprotonated carvedilol N'-β-D-glucuronide. FIG. 11*c* shows an MS/MS spectrum measured for the reaction of $HSiCl_3$ with deprotonated carvedilol N'-β-D-glucuronide.

As carvedilol N'-β-D-glucuronide eluted from the HPLC it was ionized by negative mode ESI 106. Once introduced into the mass spectrometer 102, deprotonated carvedilol N'-β-D-glucuronide was isolated. A signal from the mass spectrometer indicating the isolation was used to automatically trigger the pulse sequence, which introduced $HSiCl_3$ into the ion trap 110. The pulse sequence used included a 1 second delay after ion isolation followed by a 150 μs pulse of $HSiCl_3$. The sequence was repeated until ion isolation followed by a 30 ms reaction time ended. Ion isolation followed by reaction concluded when deprotonated carvedilol N'-β-D-glucuronide was not present anymore. This experiment demonstrates the compatibility of this pulsed valve inlet system 104 with an HPLC chromatographic time scale.

It will be appreciated that the above described embodiments are merely illustrative, and that those of ordinary skill in the art may readily devise their own implementations and modifications that incorporate the principles of the present invention and fall within the spirit and scope thereof.

We claim:

1. A multichannel inlet system for a mass spectrometer, comprising:

a plurality of valve assemblies operably coupled to a manifold, the manifold configured to be connected in fluid connection with an ion trap of the mass spectrometer, each valve assembly including, an injection port operably coupled to receive reagent, and a valve having an actuated state in which the valve provides fluid communication between the injection port and the manifold, and an unactuated state in which the valve substantially prevents fluid communication between the injection port and the manifold; and a pulsed valve driver operably connected to receive a pulse signal sequence from a controller, the pulsed valve driver configured to generate pulsed valve drive signals for one or more of the valves based on the pulse signal sequence, the pulsed valve driver configured to provide pulsed valve drive signals to each of the one more valves, each pulsed valve drive signal configured to cause a corresponding one of the valves to be in the actuated state;

a variable leak valve operably coupled to the manifold, the variable leak valve configured to be coupled to a source of inert gas and to provide the inert gas to the ion trap via the manifold; and wherein the manifold includes an outlet and a plurality of inlets arranged about the outlet, each of the plurality of inlets operably connected to a corresponding one of the plurality of valves.

2. The multichannel inlet system of claim 1, wherein the manifold has a disk shaped body having an annular wall, and wherein the plurality of inlets are disposed on the annular wall.

3. The multichannel inlet system of claim 1, wherein the pulsed valve driver is configured to generate the pulsed valve drive signals, wherein the pulsed valve drive signals have a magnitude of over 200 volts.

4. The multichannel inlet system of claim 1, wherein the pulsed valve driver includes a plurality of drive pulse generators, each drive pulse generator operably coupled to one of the plurality of valves, each drive pulse generator configured to receive a sequence pulse having a magnitude of under 10 volts and generate a corresponding one of the pulsed valve drive signals having a magnitude of over 200 volts.

5. The multichannel inlet system of claim 4, wherein each drive pulse generator includes:

a drive pulse generator output operably coupled to the one of the plurality of valves;

a voltage multiplier coupled to an AC source, and having a voltage multiplier output;

a sequence pulse input circuit configured to provide a sequence pulse trigger signal to drive a first semiconductor switch, the first semiconductor switch operably coupled to a control terminal of a second semiconductor switch, the second semiconductor switch operably coupled between the voltage multiplier output and the drive pulse generator output.

6. A multichannel inlet system for a mass spectrometer, comprising:

a plurality of valve assemblies operably coupled to a manifold, the manifold configured to be connected in fluid connection with an ion trap of the mass spectrometer, each valve assembly including, an injection port operably coupled to receive reagent, and a valve having an actuated state in which the valve provides fluid communication between the injection port and the manifold, and an unactuated state in which the valve substantially prevents fluid communication between the injection port and the manifold; and a pulsed valve driver operably connected to receive a pulse signal sequence from a controller, the pulsed valve driver configured to generate pulsed valve drive signals for one or more of the valves based on the pulse signal sequence, the pulsed valve driver configured to provide pulsed valve drive signals to each of the one more valves, each pulsed valve drive signal configured to cause a corresponding one of the valves to be in the actuated state; and a plunger supported on the manifold, the plunger configured to controllably disconnect fluid connection between the plurality of valves and the ion trap of the mass spectrometer.

7. The multichannel inlet system of claim 1, wherein each valve assembly further includes a second valve operably coupled between a source of low pressure and the valve, thereby defining an injection chamber between the valve and the second valve, and wherein the injection port is coupled in fluid communication with the injection chamber.

8. The multichannel inlet system of claim 6, wherein the manifold includes an outlet and a plurality of inlets arranged about the outlet, each of the plurality of inlets operably connected to a corresponding one of the plurality of valves.

9. The multichannel inlet system of claim 8, wherein the manifold has a disk shaped body having an annular wall, and wherein the plurality of inlets are disposed on the annular wall.

10. The multichannel inlet system of claim 9, further comprising a variable leak valve operably coupled to the central manifold, the variable leak valve configured to be coupled to a source of inert gas and to provide the inert gas to the ion trap via the manifold.

11. The multichannel inlet system of claim 8, further comprising a variable leak valve operably coupled to the central manifold, the variable leak valve configured to be coupled to a source of inert gas and to provide the inert gas to the ion trap via the manifold.

12. The multichannel inlet system of claim 6, wherein the pulsed valve driver is configured to generate the pulsed valve drive signals, wherein the pulsed valve drive signals have a magnitude of over 200 volts.

13. The multichannel inlet system of claim 6, wherein the pulsed valve driver includes a plurality of drive pulse generators, each drive pulse generator operably coupled to one of the plurality of valves, each drive pulse generator configured to receive a sequence pulse having a magnitude of under 10 volts and generate a corresponding one of the pulsed valve drive signals having a magnitude of over 200 volts.

14. The multichannel inlet system of claim 13, wherein each drive pulse generator includes:

a drive pulse generator output operably coupled to the one of the plurality of valves;

a voltage multiplier coupled to an AC source, and having a voltage multiplier output;

a sequence pulse input circuit configured to provide a sequence pulse trigger signal to drive a first semiconductor switch, the first semiconductor switch operably coupled to a control terminal of a second semiconductor switch, the second semiconductor switch operably coupled between the voltage multiplier output and the drive pulse generator output.

15. The multichannel inlet system of claim 8, wherein each valve assembly further includes a second valve operably coupled between a source of low pressure and the valve, thereby defining an injection chamber between the valve and the second valve, and wherein the injection port is coupled in fluid communication with the injection chamber.

16. The multichannel inlet system of claim 6, wherein each valve assembly further includes a second valve operably coupled between a source of low pressure and the valve, thereby defining an injection chamber between the valve and the second valve, and wherein the injection port is coupled in fluid communication with the injection chamber.

* * * * *